US010843902B2

(12) United States Patent
Studer et al.

(10) Patent No.: US 10,843,902 B2
(45) Date of Patent: Nov. 24, 2020

(54) AUTOMATED MOUNTING DEVICE FOR PERFORMING ASSEMBLY JOBS IN AN ELEVATOR SHAFT OF AN ELEVATOR SYSTEM

(71) Applicant: Inventio AG, Hergiswil (CH)

(72) Inventors: Christian Studer, Kriens (CH); Raphael Bitzi, Lucerne (CH); Erich Butler, Ebikon (CH); Andrea Cambruzzi, Zurich (CH); Philipp Zimmerli, Harkingen (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/746,161

(22) PCT Filed: Jun. 30, 2016

(86) PCT No.: PCT/EP2016/065247
§ 371 (c)(1),
(2) Date: Jan. 19, 2018

(87) PCT Pub. No.: WO2017/016783
PCT Pub. Date: Feb. 2, 2017

(65) Prior Publication Data

US 2018/0208439 A1 Jul. 26, 2018

(30) Foreign Application Priority Data

Jul. 24, 2015 (EP) ..... 15178287

(51) Int. Cl.
*B66B 19/00* (2006.01)
*B66B 7/02* (2006.01)
*B66B 11/00* (2006.01)

(52) U.S. Cl.
CPC ..... *B66B 19/00* (2013.01); *B66B 7/02* (2013.01); *B66B 7/024* (2013.01); *B66B 11/0005* (2013.01); *B66B 19/002* (2013.01)

(58) Field of Classification Search
CPC ..... B66B 19/00; B66B 19/002
See application file for complete search history.

(56) References Cited

U.S. PATENT DOCUMENTS

| | | | | |
|---|---|---|---|---|
| 3,338,336 | A | 8/1967 | Lodige | |
| 8,517,642 | B2 * | 8/2013 | Borunda | B23B 49/00 324/67 |
| 2016/0311659 | A1 * | 10/2016 | Mertala | E04G 3/246 |

FOREIGN PATENT DOCUMENTS

| | | | |
|---|---|---|---|
| CN | 104742116 | A | 7/2015 |
| JP | S642986 | A | 1/1989 |

(Continued)

*Primary Examiner* — David P Bryant
*Assistant Examiner* — Nirvana Deonauth
(74) *Attorney, Agent, or Firm* — William J. Clemens; Shumaker, Loop & Kendrick, LLP

(57) ABSTRACT

A mounting device for performing an assembly job in an elevator shaft of an elevator system has a support component and a mechatronic assembly component. The support component is configured to be moved within the elevator shaft. The assembly component is held at the support component and configured to perform a mounting step as part of the assembly job in at least a partially automatic manner. The assembly component can be an industrial robot. The mounting device allows repetitive mounting jobs, such as drilling holes and driving in screws, etc., to be performed in a partially or fully automated manner. The mounting effort, time, and/or costs thereby can be reduced.

13 Claims, 4 Drawing Sheets

(56) References Cited

FOREIGN PATENT DOCUMENTS

| | | | |
|---|---|---|---|
| JP | H0455276 | A | 2/1992 |
| JP | H04251084 | A | 9/1992 |
| JP | H05105362 | A | 4/1993 |
| JP | H07151119 | A | 6/1995 |
| JP | H08277076 | A | 10/1996 |
| JP | 3034960 | B2 | 4/2000 |
| JP | 3214801 | B2 | 10/2001 |
| RU | 2044681 | C1 | 9/1995 |
| RU | 2538742 | C2 | 1/2015 |

* cited by examiner

AUTOMATED MOUNTING DEVICE FOR PERFORMING ASSEMBLY JOBS IN AN ELEVATOR SHAFT OF AN ELEVATOR SYSTEM

FIELD

The present invention relates to a mounting device that may be used for performing assembly jobs in an elevator shaft of an elevator system. The invention relates furthermore to a method for performing an assembly job in an elevator shaft of an elevator system.

BACKGROUND

Production of an elevator system, and in particular assembly of components of the elevator system that is to be performed within an elevator shaft in a building, may involve great complexity and/or high costs, since a plurality of components must be mounted at different positions within the elevator shaft.

At this time, mounting steps that are used in the context of an assembly process, for instance to assemble a component within the elevator shaft, have generally been performed by technical or assembly personnel. Typically, a person moves to a position within the elevator shaft at which the component is to be assembled and assembles the component there at a desired location in that, for example, holes are bored into a shaft wall and the component is attached to the shaft wall with screws driven into these holes or with bolts inserted into these holes. The person may use tools and/or machines to this end.

Especially in very long elevator systems, i.e., so-called high-rise elevators, through which great differences in height are to be overcome in tall buildings, the number of the components to be installed in the elevator shaft may be very high and therefore entail assembly jobs that require considerable assembly efforts and assembly costs.

JP 3 214801 B2 describes a mounting device for aligning guide rails for an elevator car in an elevator shaft. By means of the mounting device, assembly personnel can align preassembled guide rails in the elevator shaft and attach them to holding profiles mounted by assembly personnel in the elevator shaft in the form of bracket elements. To this purpose, the mounting device has a screwing device, which is an integral part of the mounting device. The mounting device also has a fixing device by means of which the mounting device can be supported laterally on one of said bracket elements attached by the assembly personnel.

Consequently, there may be a need to reduce the workload and/or costs for the assembly of components within an elevator shaft of an elevator system. Furthermore, there may be a need to reduce the risk of accidents during assembly jobs within an elevator shaft of an elevator system. Additionally, there may be a need to be able to perform assembly jobs in an elevator shaft within shorter periods of time.

SUMMARY

According to one aspect of the invention, a mounting device is proposed for performing an assembly job in an elevator shaft of an elevator system. The mounting device has a support component and a mechatronic assembly component. The support component is adapted to be moved relative to the elevator shaft, which means, for example, within the elevator shaft, and to be positioned at different heights within the elevator shaft. The assembly component is held at the support component and adapted to perform a mounting step as part of the assembly job at least in part, and preferably, automatically.

Possible features and advantages of embodiments of the invention may be considered, inter alia, to be depending on the ideas and findings described herein below without this, however, being intended to limit the scope of the invention.

As indicated in the introduction, it was recognized that assembly jobs for mounting components in an elevator shaft of an elevator system may require a considerable amount of work, which, so far, is largely done by human assembly personnel. Depending on the size of the elevator system and therefore the number of components to be mounted, an assembly of all the components required for the elevator system often takes several days or even several weeks.

Embodiments of the invention are based, inter alia, on the idea that assembly jobs in an elevator shaft of an elevator system can be performed at least partially automatically by means of a suitably designed mounting device. Full automation of the mounting steps to be performed here would, of course, be advantageous.

Within the context of assembly jobs, particularly highly repetitive assembly steps, i.e., mounting steps that have to be carried out during the assembly of the elevator system multiple times, can be made automatically. For example, a plurality of holding profiles must typically be attached to the walls of the elevator shaft to install a guide rail in the elevator shaft, which means that holes have to be drilled first in several places along the elevator shaft and then one holding profile each must be screwed on.

For this automation purpose, it is proposed to provide a mounting device which comprises on the one hand a support component and on the other hand a mechatronic assembly component which is held on this support component.

The support component may be configured in different ways. The support component can, for example, be configured as a simple platform, rack, frame, cabin, or the like. The dimensions of the support component should be selected in such a way that the support component can be easily picked up in the elevator shaft and moved within the elevator shaft. A mechanical interpretation of the support component should be chosen such that it can reliably support the held mechatronic assembly component reliably and, if necessary, withstand the static and dynamic forces exerted by the mounting component in the performance of an assembly step.

The assembly component is to be mechatronic, that is, to be having cooperating mechanical, electronic, and information technology elements or modules.

The assembly component is, for example, to have suitable mechanisms in order to handle tools, e.g., within a mounting step. The tools can here be suitably brought to an assembly position by the mechanisms and/or suitably guided during a mounting step. The tools can also be supplied with energy, for example in the form of electrical energy, by the assembly component. It is also possible that the tools have their own energy supply, for example from batteries, rechargeable batteries, or a separate power supply through cable.

Alternatively, the assembly component may comprise a suitable mechanism itself that forms a tool.

Electronic elements or modules in the mechatronic assembly component can serve, for example, to suitably access or control mechanical elements or modules of the assembly component. Such electronic elements or modules can therefore serve, for example, for controlling the assembly component.

Furthermore, the assembly component may include information technology elements or modules which can be used to determine, for example, the position to where a tool should be brought and/or how the tool should be operated and/or guided during a mounting step.

An interaction between the mechanical, electronic, and information technology elements or modules is intended to take place in such a way that at least one mounting step of the assembly job can be performed by the mounting device either partially or fully automatically.

Further guidance components may be provided at the support component with which the support component can be guided during a vertical move within the elevator shaft along one or more of the walls of the elevator shaft. The guidance components may be configured, for example, as support rollers, which roll on the walls of the elevator shaft. Depending on the arrangement of the support rollers on the support component, one to up to in particular four support rollers can be provided.

It is also possible that guide ropes are stretched in the elevator shaft that are used to guide the support component. In addition, temporary guide rails can be mounted in the elevator shaft to guide the support component. Moreover, it is possible that the support component is hung over two or more resilient, bendable support means such as ropes, a chain, or belts.

According to one embodiment, the mechatronic assembly component has an industrial robot.

An industrial robot may be understood as a universal, usually programmable, machine for handling, mounting, and/or processing of workpieces and components. Such robots are designed for use in an industrial environment and are, for example, used in the industrial production of complex goods in large quantities, for example in automotive manufacturing.

Typically, an industrial robot comprises a so-called manipulator, a so-called effector, and a controller. The manipulator can be, for example, a robot arm that is pivotable around one or more axes and/or displaceable along one or more directions. The effector can be, for example, a tool, a gripper, or the like. The controller may be used to suitably drive the manipulator and/or the effector, i.e., to suitably relocate and/or guide them.

The industrial robot is particularly adapted to be coupled with various mounting tools at its cantilever end. In other words, the manipulator is adapted to be coupled with different effectors. This allows for a particularly flexible use of the industrial robot and thus the mounting device.

The controller of the industrial robot has in particular a so-called power unit and a control PC. The control PC performs the actual calculations for the desired movements of the industrial robot and sends control commands for the control of the individual electric motors of the industrial robot to the power unit, which then converts these into specific activations of the electric motors. The power unit is arranged in particular on the support component, whereas the control PC is not arranged on the support component, but in or beside the elevator shaft. If the power unit were not arranged on the support component, a plurality of cable connections would have to be guided through the elevator shaft to the industrial robot. By arranging the power unit on the support component, mainly only a power supply and a communication link, for example in the form of an Ethernet connection between the control PC and the power supply, must be provided for the industrial robot in particular by means of a so-called hanging cable. This allows a particularly simple cable connection, which, moreover, is very robust and less susceptible to errors because of the small number of cables. Other functions, such as a security monitoring in the control of the industrial robot, may be realized which may be required for further cable connections between the control PC and power unit.

The industrial robot may also have a so-called passive auxiliary arm, which can only be moved together with the robot arm and which, in particular, comprises a device for holding a component, comprising for example a support bracket. To attach the support bracket to a wall of the elevator shaft, the robot arm can be moved, for example, so that the support bracket is taken up by the passive auxiliary arm and held in the correct position during the actual mounting for example by means of a screw.

Often industrial robots are also equipped with various sensors, with which they can identify information for example about their environment, working conditions, components to be processed, or the like. It is possible for example with the help of sensors to detect forces, pressures, accelerations, temperatures, positions, distances, etc., in order to then evaluate them accordingly.

After an initial programming, an industrial robot is typically capable of performing a work process, partially or fully automatically, that is largely autonomous. An embodiment of the work process can be varied within certain limits, for example, depending on sensor information. Furthermore, a self-learning control of an industrial robot may optionally be carried out.

Depending on a manner in which its components are configured mechanically and/or electrically as well as a manner in which these components can be controlled using the controller of the industrial robot, an industrial robot can thus be capable of performing different mounting steps of an assembly job in an elevator shaft or respectively to adapt to different situations during such mounting step.

In this context, advantageous properties can already be provided in many parts of fully developed industrial robots, as they are already in use in other areas of technology, and, where appropriate, only need to be adapted to the special circumstances of the assembly jobs in elevator shafts of elevator systems. To bring the industrial robot to a desired position in the elevator shaft, for example, it is attached to the support component, wherein the support component together with the industrial robot and optionally other assembly components can be taken to a desired position in the elevator shaft.

As an alternative to the embodiment as an industrial robot, the mechatronic assembly component can be configured in another way as well. Conceivable are, for example, machines specifically designed for said application in a (partially) automated elevator assembly where for example special drills, screwdrivers, feed components, etc., are used. Linearly movable drilling tools, screwing tools, and the like could be used here for example.

According to one embodiment, the mounting device may further comprise a positioning component which is adapted to determine at least one of a position and an orientation of the mounting device within the elevator shaft. In other words, the mounting device is to be able by means of its positioning component to determine its position or pose with respect to the current location and/or orientation within the elevator shaft.

In other words, the positioning component can be provided to determine an accurate position of the mounting device within the elevator shaft with a desired accuracy, for example, an accuracy of less than 10 cm, preferably less than 1 cm or less than 1 mm. An orientation of the mounting device can also be detected with high accuracy, i.e., for example an accuracy of less than 10°, preferably less than 5° or 1°.

Optionally, the positioning component can be adapted in this case to measure the elevator shaft from its current position. In this way, the positioning component can, for example, recognize where it is currently in the elevator shaft and how great the clearances are to walls, ceiling, and/or the floor of the elevator shaft, etc. In addition, the positioning component can detect, for example, how far it is removed from a target position so that, based on this information, the mounting device can be moved in a desired manner to reach the target position.

The positioning component can determine the position of the mounting device in different ways. For instance, a position determination by using optical measurement principles is conceivable. For example, laser distance measuring devices can measure distances between the positioning component and walls of the elevator shaft. Other optical methods such as stereoscopic measurement methods or measurement methods based on triangulation are conceivable as well. In addition to optical measurement methods, various other positioning methods are conceivable as well, for example, based on radar reflections or the like.

According to one embodiment, the assembly component is adapted to perform several different mounting steps at least partially automatically, but preferably fully automatically. In particular, the assembly component can be adapted hereby to use various mounting tools such as, for example, a drill, a screwdriver, and/or a gripper for the different mounting steps.

The ability to use various mounting tools enables the mechatronic assembly component to simultaneously or sequentially perform various mounting processes during an assembly job in order to, for example, be able to eventually assemble a component within the elevator shaft at an appropriate position.

The assembly component is particularly adapted in such a way that it picks up the assembly tools used for the different types of mounting steps before the execution of the mounting step. The assembly component can thus put down an assembly tool that is not required for the next mounting step and pick up the mounting tool that is required instead; i.e., it can switch mounting tools. The assembly component can thus always only be coupled with the mounting tool that is currently needed. The assembly component therefore only requires a small amount of space and can perform mounting steps at many places. It is therefore very flexible. If the assembly component were always coupled with all assembly tools required for the various mounting steps, it would require significantly more space. The respective mounting tools could thus be used at significantly fewer places.

According to one embodiment, the mounting device includes a tool magazine component which is adapted to store mounting tools required for different mounting steps and to provide the assembly component. Thus, unneeded mounting tools can be kept safe and can be protected during the execution of operations and during the movement of the mounting device in the elevator shaft against falling.

For example, the assembly component is designed according to the embodiment to drill holes in a wall of the elevator shaft in at least a partially automatic, controlled mounting step.

The assembly component can use a suitable drill for this purpose. Both the tool and the assembly component itself should be suitably configured so that they can handle the conditions occurring in the elevator shaft during the mounting step.

For example, the walls of an elevator shaft where components are to be mounted are often made of concrete, particularly reinforced concrete. Very strong vibrations and high forces can occur when drilling holes in concrete. Both a drilling tool as well as the assembly component itself should be suitably designed to withstand such vibrations and forces.

To this purpose, it may, for example, be necessary to appropriately protect an industrial robot used as an assembly component from damage due to strong vibrations and/or the high forces taking effect. It may be advantageous, for example, to provide one or more damping elements in the assembly component to dampen or absorb vibrations. It is also possible that one or more damping elements are arranged at a different place in the combination of the mounting tool and the assembly component. A damping element may for example be integrated into the mounting tool or arranged in a connecting element between the assembly component and mounting tool. In this case, the mounting tool and the connection element can be considered part of the assembly component. A damping element is realized for example as one or more parallel rubber buffers, which are available in a large selection and at low cost on the market. Even a single rubber buffer can be considered as a damping element. It is also possible that a damping element is designed as a telescopic damper.

The drills used are subject to wear and can be damaged, for example, when hitting a reinforcement. To detect a worn or defective drill, for example, a feed can be monitored during drilling and/or a period of time for introducing a hole of a desired depth. When falling below a feed limit and/or when a time limit is exceeded, the drill used is recognized as no longer in order and generates a respective message.

According to one embodiment, the assembly component can be adapted to drive screws into holes in a wall of the elevator shaft in an at least partially automated manner as a mounting step.

In particular, the assembly component may be adapted to drive concrete screws into prefabricated holes in a concrete wall of the elevator shaft. With the help of such concrete screws, highly resilient stopping points can be created within the elevator shaft to which, for example, components can be attached. Concrete screws can be driven directly into concrete here, that is, without the use of plugs necessarily, thus enabling quick and easy mounting. However, for driving in screws, concrete screws in particular, high forces or torques may be required, which the assembly component or a mounting tool it is controlling should be able to provide.

According to a further embodiment, the assembly component can be configured to at least partially automatically attach components on the wall of the elevator shaft as a mounting step. In this context, components may be different types of shaft material such as holding profiles, portions of guide rails, screws, bolts, clamps, or the like.

According to one embodiment, the mounting device further includes a magazine component which is designed to store components to be assembled and to provide them to the assembly component.

The magazine component can, for example, provide a plurality of screws, concrete screws in particular, and provide these to the assembly component as necessary. The magazine component can provide the stored components to the assembly component either actively or passively by enabling the assembly component to actively remove and mount these components.

The magazine component can optionally be configured to store various components and provide them simultaneously or sequentially to the assembly component. Alternatively, several different magazine components may be provided in the mounting device.

According to one embodiment, the mounting device may further comprise a displacement component which is adapted to vertically move the support component within the elevator shaft.

In other words, the mounting device itself may be configured to appropriately move its support component within the elevator shaft by using its displacement component. The displacement component will in this case generally have a drive, by means of which the support component can be moved within the elevator shaft, i.e., for example between different floors of a building. Further, the displacement component will have a controller with which the drive can be operated in such a way that the support component can be brought to a desired position within the elevator shaft.

As an alternative to the displacement component itself being part of the mounting device, a displacement component can also be provided externally. For example, a drive premounted in the elevator shaft can be provided as a displacement component. Where appropriate, this drive may already be a main motor to be used later for the elevator system with which an elevator car is to be moved in the finished assembly state and that can be used during the preceding assembly process to move the support component. In this case, a data communication possibility may be provided between the mounting device and the external displacement component so that the mounting device can cause the displacement component to move the support component within the elevator shaft to a desired position.

Similar to the fully assembled elevator system, the support component can, in this case, be connected with a counterweight by means of a carrier means that is strong and flexible under tension such as a rope, a chain, or a belt, for example, and the drive acts between the support component and the counterweight. In addition, the same drive configurations are possible for the movement of the support component as for the movement of elevator cars.

The displacement component can be designed in different ways to be able to move the support component together with the assembly component arranged with it within the elevator shaft.

For example, according to one embodiment, the displacement component can be fixed either on the support component of the mounting device or at a top stop of the elevator shaft and have a carrier means that is strong and flexible under tension such as a rope, a chain, or a belt, the end of which is held at the displacement component and whose other end is fixed at the respective other element, i.e., at the top stop within the elevator shaft or respectively on the support component. In other words, the displacement component can be attached to the support component of the mounting device, and a carrier means held at the displacement component can be attached to a stop within the elevator shaft at its other end. Or vice versa, the displacement component can be attached at its top stop in the elevator shaft, and the free end of its carrier means can then be attached to the support component of the mounting device. The displacement component can then be systematically moved by displacing the carrier means of the support component within the elevator shaft.

Such a displacement component can, for example, be provided as a type of rope winch, in which a flexible rope can be rolled up on a winch driven by an electric motor. The rope winch can be either fixed to the support component of the mounting device or, alternatively, for example, to the top of the elevator shaft, for example on an elevator shaft ceiling. The free end of the rope can then be mounted oppositely either at the top in the elevator shaft or at the bottom of the support component. By means of a systematic winding and unwinding of the rope on the winch, the mounting device can then be moved within the elevator shaft.

Alternatively, the displacement component can be attached to the support component and may be adapted to exert a force on a wall of the elevator shaft by moving a displacement component to move the support component within the elevator shaft by moving the motion component along the wall.

In other words, the displacement component can be directly attached to the support component and move actively along the wall of the elevator shaft using its displacement component.

For example, the displacement component may have a drive for this purpose that moves one or more movement components in the form of wheels or rollers, wherein the wheels or rollers are pressed against the wall of the elevator shaft, so that the wheels or rollers, offset from the drive when in rotation, can roll along the wall as slip-free as possible and therein can move the displacement component together with the support component attached to it within the elevator shaft.

Alternatively, it would be conceivable for a movement component of a displacement component to transfer forces to the wall of the elevator shaft in another manner. Gears could, for example, serve as displacement components and engage in a rack attached to the wall in order to be able to vertically move the displacement components in the elevator shaft.

According to one embodiment, the support component comprises an additional fixing component which is configured to fix the support component and/or the assembly component within the elevator shaft in a direction that is diagonal from the vertical direction, i.e., for example in a horizontal or respectively lateral direction.

The fixing in a lateral direction can be understood to mean that the support component together with the assembly component attached to it not only can be moved to a position at a desired height within the elevator shaft, for example by means of the displacement component, but that the support component can be fixed there in the horizontal direction as well by means of the fixing component.

A stabilizing at a wall is meant in this context in particular that the fixing component is supported directly and without the interposition of premounted wall components such as, for example, bracket elements, i.e., that it can pass forces into the wall. The stabilizing can be effected in various ways.

In a special embodiment, the fixing component is adapted to at least one of the support components and the assembly component within the elevator shaft in a direction along the vertical.

The fixing component can be configured for this purpose in such a way, for example, that it is stabilized laterally on the walls of the elevator shaft or that it is fixed in place in such a way that the support component can no longer move in the horizontal direction relative to the walls. For this purpose, the fixing component can, for example, have suitable supports, props, arms, or the like. The supports, props, or arms may, in particular, be configured in such a way that they can be moved outward toward the wall of the elevator shaft and thus pressed against the wall. It is possible here that supports, props, or arms are arranged on opposite sides of the support component or the assembly component that are all outwardly movable.

It is also possible that supports, props, or arms are arranged in an outwardly movable manner on only one side and that there is a fixed stabilizing element on the opposite side. In particular, the stabilizing element has a form that is elongated in the vertical direction and that extends in particular at least across the entire length of the support component. It has, for example, a principally beam-like basic shape. The assembly device is, in particular, brought into the elevator shaft in such a way that the stabilizing element is arranged on one side with doorways in the walls of the elevator shaft. Due to the elongated form, the stabilizing element is able to provide adequate support even when the mounting device is to be attached in the area of a doorway.

The stabilizing element can, in particular, be configured in such a way that its distance to the support component is manually adjustable, particularly in different stages. The distance can only be adjusted by hand, and such an adjustment is only made before the mounting device is brought into the elevator shaft. This way, the fixing device can be adjusted to the dimensions of the elevator shaft.

Deformation may occur when the fixing into place occurs opposite the walls of the elevator shaft. This is particularly the case when the stabilizing or fixing into place takes place in the area of a doorway. The deformation may cause the relative position of a magazine component described above to change, which may lead to problems relating to the picking up of tools and the components to be assembled by the assembly component. Such problems may be avoided, for instance, when the support component is embodied rigidly enough that it does not deform when stabilizing or fixing in place or the magazine components are arranged relative to the assembly component such that their relative positions to one another do not change, even if the support component deforms.

It is also possible for the fixing device to have suction cups via which a retention force relative to a wall of the elevator shaft may be created, and thus the support component may be fixed relative to the walls of the elevator shaft. For instance, a negative pressure can be generated via a pump in order to increase the retention force. The support component supports itself on the walls of the elevator shaft via the suction cups. Fixation by means of suction cups acts vertically as well.

It is also possible for the support component to be temporarily fixed by means of fasteners, for instance in the form of screws, bolts, or nails, to one or more walls of the elevator shaft and thus to support itself on the wall. This support acts vertically as well. This temporary fixation is released when the support component is to be moved to another position within the elevator shaft.

Furthermore, the support component can be stabilized through components already mounted in the elevator shaft such as holding profiles and fixed in this way. The stabilizing can be carried out in such a way as well that it acts in the vertical direction as well.

During the use of a tool within a mounting step, it is also possible for only the specific tool to be fixed relative to a wall of the elevator shaft. To this end, a frame, relative to which the tool is movably guided, for example via suction cups, may be fixed on a wall of the elevator shaft. It is also possible for the aforementioned frame to be temporarily fixed by means of fasteners, for instance in the form of screws, bolts, or nails, to a wall of the elevator shaft.

In that the fixing component fixes the support component laterally within the elevator shaft, it may be possible, for instance, to prevent the support component from being able to move horizontally within the elevator shaft during a mounting step in which the assembly component works and, for instance, exerts transverse forces on the support component. In other words, the fixing component may act like a counter-bearing for the assembly component attached to the support component so that the assembly component can stabilize itself laterally on the walls of the elevator shaft indirectly via the fixing component. Such lateral stabilizing may be necessary, for instance, during a drilling process, in order to absorb the horizontally acting forces occurring and to prevent or dampen vibrations.

In a special configuration of this embodiment, the support component may have two parts. The installation component is attached to a first part. The fixing component is attached to a second part. The support component may furthermore have an aligning component which is configured to align the first part of the support component relative to the second part of the support component, for example by rotating it around a spatial axis.

In such an embodiment, the fixing component can fix the second part of the support component within the elevator, for example by laterally stabilizing itself on the walls of the elevator shaft. Especially preferred is a configuration of the fixing component in which the second part of the support component is stabilized at a wall on the side of the shaft access and an opposite wall. The aligning component of the support component can then align the other, first part of the support component in a desired manner relative to the laterally fixed second part of the support component, for example if the aligning component rotates this first part by at least a spatial axis. This way, the assembly component attached to the first part is moved as well. This way, the assembly component can be brought in a position and/or orientation in which it can easily and specifically perform a desired mounting step.

According to one embodiment, the mounting device further includes a reinforcement detection component which is designed to detect a reinforcement within a wall of the elevator shaft.

The reinforcement detection component is thus able to detect a reinforcement such as a steel section in a location that is usually not visibly noticeable and deeper within a wall. Information about the existence of such a reinforcement may for example be advantageous if holes are to be drilled into a wall of the elevator shaft as an assembly step, since then it is possible to avoid drilling into the reinforcement and thereby damaging the reinforcement and possibly a drilling tool.

Moreover, the assembly device may have a scanning component, by means of which a distance to an object such as a wall of the elevator shaft can be measured. The scanning component can, for example, be guided by the assembly component in a defined movement along the wall of the elevator shaft, and the distance to the wall can be measured continuously. This way, conclusions can be drawn to an angular position of the wall and the condition of the wall with regard to irregularities, ledges, or existing holes. The information obtained can be used, for example, for an adjustment of the control of the assembly component such as a change to a planned drilling position.

Alternatively or additionally, the scan component can be guided along the wall in a zig-zag pattern in an area in which a bracket element is to be mounted, thereby creating a height profile of the wall from the measured distances. This height profile can be used as described for adapting the control of the assembly component.

Another aspect of the invention relates to a method for performing an assembly job in an elevator shaft of an elevator system. The method comprises introducing a mounting device according to one embodiment, as described herein, in an elevator shaft, a controlled movement of the mounting device within the elevator shaft, and finally an at least partially automated, preferably fully automatic, execution of a mounting step during the assembly process by means of the mounting device.

In other words, the mounting apparatus described above can be used to perform mounting steps of an assembly job in an elevator shaft in an either partially or fully automated manner, and therefore in an either partially or fully autonomous manner.

It should be noted that some of the features and advantages of the invention are described here with reference to different embodiments. What is described in particular are some of the features relating to a mounting device according to the invention and some of the methods relating to the invention for the performance of an assembly job in an elevator shaft. A person skilled in the art recognizes that the features may be combined, adapted, or exchanged as appropriate in order to yield other embodiments of the present invention. A person skilled in the art recognizes in particular that device features that are described with reference to the mounting device can be similarly adapted in order to describe an embodiment of the method according to the invention, and vice-versa.

Embodiments of the present invention are described below with reference to the accompanying drawings, wherein neither the drawings nor the description are to be interpreted as limiting the present invention.

The drawings are only schematic and are not true to scale. Like reference signs refer in different drawings to like or analogous features.

DETAILED DESCRIPTION

Figure 1:
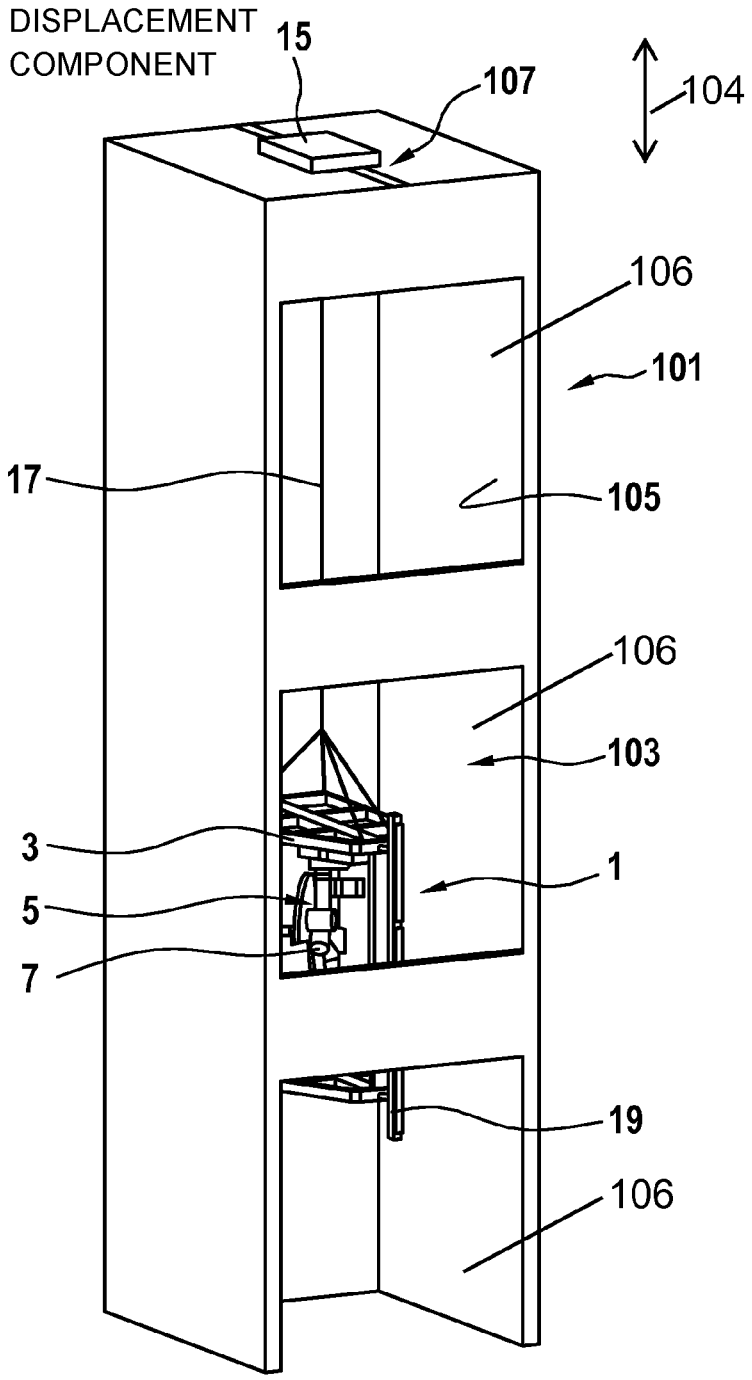
FIG. 1 illustrates a perspective view of an elevator shaft of an elevator system with a mounting device according to an embodiment of the present invention comprised therein.

FIG. 1 illustrates an elevator shaft 103 of an elevator system 101 in which a mounting device 1 according to an embodiment of the present invention is arranged. The mounting device 1 has a support component 3 and a mechatronic assembly component 5. The support component 3 is configured as a rack to which the mechatronic assembly component 5 is mounted. The dimensions of this rack make it possible to move the support component 3 within the elevator shaft 103 in a vertical direction, i.e., along the vertical 104, i.e., to move it to different vertical positions on different floors within a building. In the illustrated example, the mechatronic assembly component 5 is configured as an industrial robot 7 which is attached to the rack of the support component 3 in a downward-hanging manner. An arm of the industrial robot 7 can be moved relative to the support component 3 and thus displaced for example toward a wall 105 of the elevator shaft 3.

Through a steel rope serving as a carrier means 17, the support component 3 is connected to a displacement component 15 in the form of a motorized winch which is attached at the top of the elevator shaft 103 at a stop 107 on the ceiling of the elevator shaft 103. By means of the displacement component 15, the mounting device 1 can be vertically moved within the elevator shaft 103 across an entire length of the elevator shaft 103.

Furthermore, the assembly device 1 comprises a fixing component 19 with which the support component 3 can be fixed within the elevator shaft 103 in the lateral direction, i.e., in the horizontal direction. The fixing component 19 on the front side of the support component 3 and/or the prop (not shown) on a rear side of the support component 3 can, for this purpose, be moved outward to the front or the back and, in this way, stabilize the support component 3 between the walls 105 of the elevator shaft 103. The fixing component 19 and/or the prop can be spread outward in this regard by means of hydraulics or the like to fix the support component 3 in the elevator shaft 103 in a horizontal direction. Alternatively, it is conceivable to only fix parts of the assembly component 5 in the horizontal direction, for example by stabilizing a drill correspondingly on walls of the elevator shaft 103.

Figure 2:
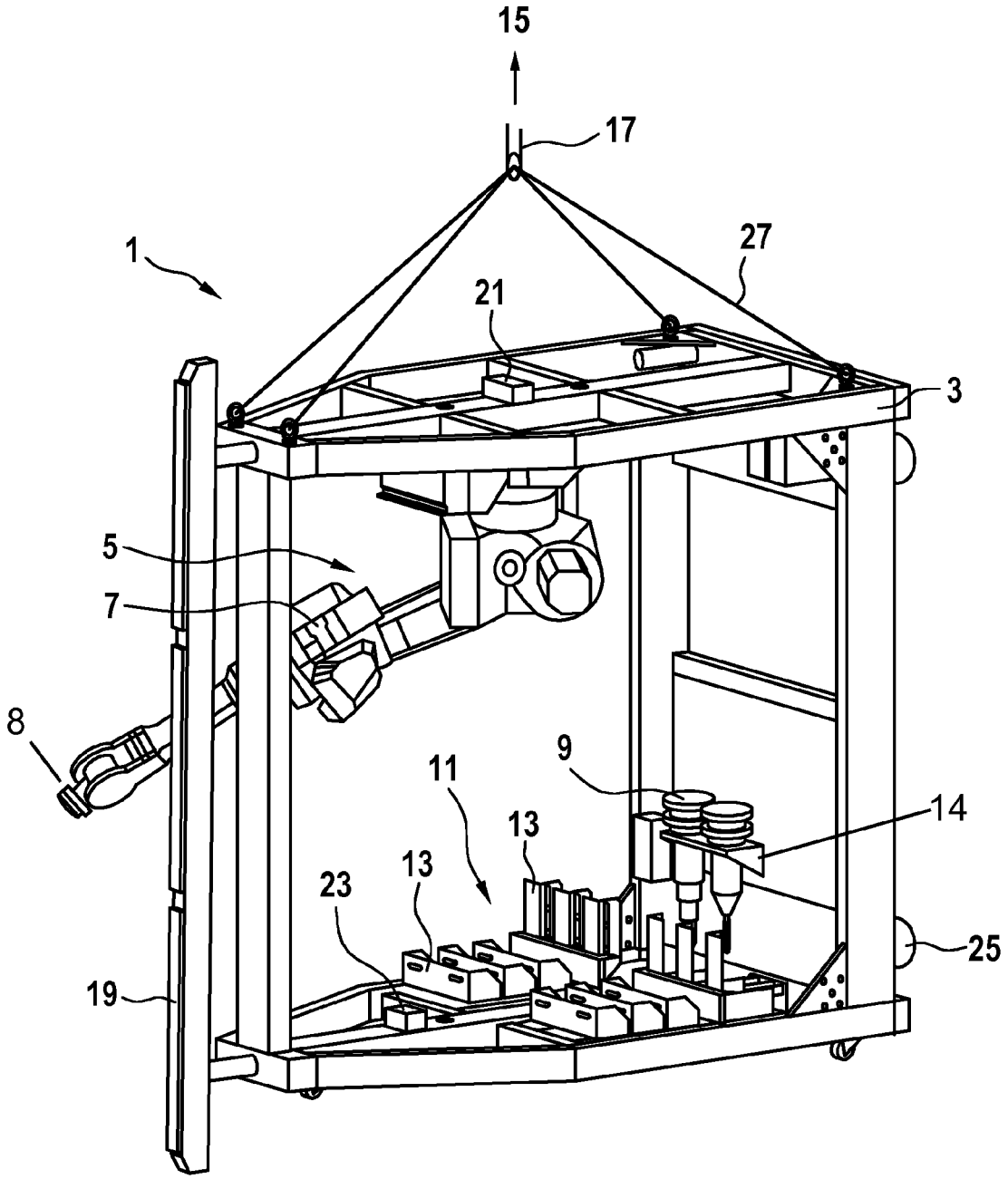
FIG. 2 illustrates a perspective view of a mounting device according to one embodiment of the present invention.

FIG. 2 illustrates an enlarged view of a mounting device according to one embodiment of the present invention.

The support component 3 is formed as a cage-like frame in which a plurality of horizontally and vertically extending beams form a mechanically robust structure. A dimensioning of the beams and possibly provided bracing is designed such that the support component 3 may withstand forces that may occur during various mounting steps performed by the assembly component 5 within the context of an assembly job in the elevator shaft 103.

Retaining cables 27 are attached to the cage-like support component 3 which can be connected to a carrier means 17. By displacing the carrier means 17 within the elevator shaft 103, that is, for example, by winding and unwinding the flexible carrier means 17 on the winch of the displacement component 15, the support component 3 can be displaced within the elevator shaft 103 in a suspended manner.

In an alternative embodiment (not shown) of the mounting device 1, the displacement component 15 can also be provided directly on the support component 3 and can, for example by means of a winch, pull the support component 3 on a carrier means rigidly attached at the top of the elevator shaft 103 up or lower it down.

In a further possible embodiment (not shown), the displacement component 15 could also be directly affixed on the support component 3 and, for example with a drive, drive rollers that are firmly pressed against the walls 105 of the elevator shaft 103. In such an embodiment, the mounting device 1 in the elevator shaft 103 could, for example, move automatically in the vertical direction without advance installations having to be made within the elevator shaft 103, in particular without, for example, a carrier means 17 having to be provided within the elevator shaft 103.

Further guidance components, for example in the form of support rollers 25, may be provided at the support component 3 with which the support component 3 can be guided during a vertical movement within the elevator shaft 103 along one or more of the walls 105 of the elevator shaft 103.

The fixing component 19 is provided next to the support component 3. In the example shown, the fixing component 19 is formed with an elongated beam extending in the vertical direction which can be moved in the horizontal direction with respect to the frame of the support component 3. The beam may be attached to the support component 3 for example by means of a lockable hydraulic cylinder or a self-locking motor spindle. If the beam of the fixing component 19 is moved away from the frame of the support component 3, it moves laterally toward one of the walls 105 of the elevator shaft 103. Alternatively or additionally, props can be moved backward at the rear of the support component 3 in order to spread the support component 3 in the elevator shaft 103. In this way, the support component 3 can be stabilized within the elevator shaft 103 and thereby, for example, fix the support component 3 within the elevator shaft 103 in the lateral direction during an execution of a mounting step. Forces which are applied onto the support component 3 can be transferred in this state to the walls 105 of the elevator shaft 103, preferably without the support component 3 being moved within the elevator shaft 103 or starting to vibrate.

In a special embodiment (not shown in detail), the support component 3 consists of two parts. The installation component 5 can be attached here to a first part and the fixing component 19 attached to a second part. In such a configuration, an aligning component may be provided on the support component 3 that makes a controlled alignment of the first part of the assembly component 5 opposite the second part of the support component 3 fixable within the elevator shaft 103. The aligning device may, for example, move the first part by at least one spatial axis relative to the second part.

In the illustrated embodiment, the mechatronic assembly component 5 is configured by means of an industrial robot 7. It is noted, however, that the mechatronic assembly component 5 can also be realized in other ways, for example with differently configured actuators, manipulators, effectors, etc. In particular, the assembly component could comprise mechatronics or robotics specially adapted for use for an assembly job within an elevator shaft 103 of an elevator system 1.

In the example shown, the industrial robot 7 is equipped with several robotic arms pivotable around pivot axes. The industrial robots may, for example, have at least six degrees of freedom, which means that a mounting tool 9 guided by the industrial robot 7 can be moved with six degrees of freedom, that is, for example, with three degrees of rotational freedom and three degrees of translational freedom. The industrial robot can, for example, be configured as a vertically articulated robot, a horizontally articulated robot, or a SCARA robot or Cartesian robot or, respectively, a portal robot.

The robot can be coupled with different mounting tools 9 at its cantilevered end 8. The assembly tools 9 may differ in their configuration and their intended use. The assembly tools 9 can be held at the support component 3 in a tool magazine component 14 in such a way that the cantilevered end of the industrial robot 7 can be brought up to them and be coupled with one of them. The industrial robot 7 can, for this purpose, have a tool-changing system for this purpose which is designed in such a way that it allows at least the handling of several such mounting tools.

One of the mounting tools can be configured as a drilling tool similar to a drilling machine. By the coupling of the industrial robot 7 with such a drilling tool, the assembly component 5 can be configured in such a way that it allows for an at least partially automated, controlled drilling of holes, for example in one of the shaft walls 105 of the elevator shaft 103. The drilling tool may be moved and handled by the industrial robot 7 here in such a way that the drilling tool with a drill can drill holes at a designated location, for example in the concrete of the wall 105 of the elevator shaft 103 into which the fastening screws can be driven in later to affix fastening elements. The drilling tool as well as the industrial robot 7 can be suitably configured in such a way that they can withstand, for example, the considerable forces and vibrations that may occur when holes are drilled into concrete.

Another assembly tool 9 can be configured as a screwing device to drive screws into previously drilled holes in a wall 105 of the elevator shaft 103 in an at least partially automatic manner. The screwing device can, in particular, be configured such that with its help concrete screws can be driven into the concrete of a shaft wall 105 as well.

A magazine component 11 can be provided the support component 3 as well. The magazine component 11 can serve to store components 13 to be installed and to provide the assembly component 5. In the example shown, the magazine component 11 is arranged in a lower portion of the frame of the support component 3 and hosts various components 13, for example in the form of different profiles that are to be installed within the elevator shaft 103 on walls 105, for example guide rails for the elevator system 101, to fasten to them. The magazine component 11 may also be used to store and make available screws which can be driven into prefabricated holes into the wall 105 by means of the assembly component 5.

In the example shown, the industrial robot 7, for example, automatically grabs a fastening bolt from the magazine component 11 and can partially drive it into previously drilled mounting holes in the wall 105, for example, with a mounting tool 9 designed as a screwing device. Subsequently, a mounting tool 9 can be switched on the industrial robot 7 and, for example, a component 13 to be mounted can be pulled out of the magazine component 11. The component 13 may have fastening slots. When the component 13 is brought into an intended position by using the assembly component 5, the previously partially driven-in fastening screws can engage in these fastening slots and extend through them. Subsequently, the mounting tool 9 configured as a screwing device can be reconfigured again, and the fastening screws are tightened.

In the illustrated example it becomes apparent that, by using the mounting device 1, an assembly job in which components 13 are mounted to a wall 105 can be carried out in a completely or at least partially automated manner in which, first, the assembly component 5 drills holes into the wall 105 and then fastens components 13 in these holes by using fastening screws.

Such an automated assembly process can be carried out relatively quickly and can, particularly regarding multiple repetitive assembly jobs to be carried out within an elevator shaft, help save considerable installation effort and therefore time and costs. Since the mounting device can perform the assembly process in a largely automated manner, interactions with human assembly personnel can be avoided or at least reduced to a low level, so that risks that typically occur otherwise in the context of such assembly jobs as well, especially the risk of accidents, can be significantly reduced for assembly personnel.

In order to accurately position the mounting device 1 within the elevator shaft 103, a positioning component 21 may be provided as well. Positioning component 21 can be firmly attached, for example, to the support component 3 and thus be moved as well in the process of mounting device 1 within the elevator shaft 103. Alternatively, the positioning component 21 may also be arranged independently from the mounting device 1 at a different position within the elevator shaft 103 and can from there determine a current position of the mounting device 1.

The positioning component 21 can use different measurement principles in order to precisely determine the current position of the mounting device 1. In particular, optical methods seem to be suitable to produce a desired accuracy when determining the position, for example, less than 1 cm, preferably less than 1 mm, within the elevator shaft 103. A control in the mounting device 1 can analyze signals from the positioning component 21 and determine on the basis of these signals an actual position relative to a desired position within the elevator shaft 103. Based on this, the control then can, for example, first move or have the support component 3 moved within the elevator shaft 103 to a desired height. Subsequently, the control can, in consideration of the then determined actual position, suitably manipulate the assembly component 5 so that, for example, holes are drilled, screws are driven in, and/or ultimately components 13 are mounted at the desired locations within the elevator shaft 103.

The mounting device 1 may also have a reinforcement detection component 23. In the illustrated example, the reinforcement detection component 23 is accommodated in the magazine component 11 similar to one of the mounting tools 9 and can be handled by the industrial robot 7. In this way, the industrial robot 7 can move the reinforcement detection component 23 to a desired location where subsequently a hole is to be drilled into the wall 105. Alternatively, the reinforcement detection component 23 could, however, be provided to the mounting device 1 in a different manner as well.

The reinforcement detection component 23 is adapted to detect a reinforcement within the wall 105 of the elevator shaft 103. For this purpose, the reinforcement detection component can, for example, employ physical measurement methods in which the electric and/or magnetic properties of the typically metallic reinforcement in a concrete wall are used to precisely determine the location of this reinforcement.

If, while using the reinforcement detection component 23, a reinforcement was to be detected within the wall 105, a control of the mounting device 1 can, for example, correct previously assumed positions of holes to be drilled in such a way that there is no overlap between the holes and the reinforcement.

In summary, a mounting device 1 is described with which an assembly job within an elevator shaft 103 can be performed either partially or fully automated, for example in a robot-assisted manner. The mounting device 1 can here at least assist assembly personnel during the assembly of components of the elevator system 101 within the elevator shaft 103, that is, for example, carry out preparatory work. In particular, work steps that are performed multiple times, i.e., repetitive work steps, can be performed quickly, precisely, and at a low-risk and/or cost-effective manner. The assembly process steps performed during a mounting job can differ with regard to individual work steps to be performed, a series of work steps, and/or a necessary interaction between humans and machines. The mounting device 1 can, for example, perform parts of the assembly job in an automated manner, but assembly personnel can interact with the mounting device 1 in that mounting tools 9 can be manually changed and/or components can, for example, be refilled in the magazine component by hand. Intermediate working steps that are performed by an assembly worker are conceivable as well. The functional scope of a mechatronic assembly component 5 provided in a mounting device 1 may comprise all or part of the steps listed below:

- The elevator shaft 103 can be measured. Here, for example, doorways 106 can be detected, an exact alignment of the elevator shaft 103 can be recognized, and/or a shaft layout can be optimized. If applicable, real survey data from the elevator shaft 103 obtained from a measurement can be compared with map data, as provided for example in a CAD model of the elevator shaft 103.
- An orientation and/or location of the mounting device 1 inside the elevator shaft 103 can be determined.
- Reinforcing bars or reinforcements in walls 105 of the elevator shaft 103 can be detected.
- Then preparations such as drilling, milling, cutting work, etc., can be carried out, whereby these preparations can preferably be performed by the assembly component 5 of the mounting device 1 in a partially or fully automatic manner.
- Then components 13 such as fastening elements, interface elements, and/or bracket elements can be installed. Concrete screws, for example, can be screwed into previously drilled holes, bolts can be driven in, or parts can be welded together, nailed, and/or glued or the like.
- Components and/or shaft material such as brackets, rails, manhole door elements, screws, and the like can be handled in a fully automated manner, assisted by the mounting device 1.
- Required materials and/or components can be replenished in the mounting device 1 either in an automated manner and/or supported by personnel. Through these and possibly other steps, work steps and work flow relating to an assembly job within an elevator shaft 103 can be coordinated with each other and machine-human interactions minimized, for example, meaning that a system is created that works as autonomously as possible. Alternatively, a less complex and thus more robust system for a mounting device can be used, in which case an automation is only established to a lesser extent, and thus typically more machine-human interactions are necessary.

The displacement component for moving the mounting device in the elevator shaft can also be arranged on the support component of the mounting device and impact the walls of the elevator shaft. Such a mounting device 1 in an elevator shaft 103 is shown in a view from above in FIG. 3. A displacement component 115 has two electric motors 151 which are arranged on the support component 3 of the mounting device 1. A rotatable shaft 153 is attached with two guides 152, each on opposite sides of the support component 3. Two wheels 154 are rotatably mounted on the axes 153 relative to the axes 153. The wheels 154 can roll on walls 105 of the elevator shaft 103 and are pressed on pressing devices not shown there against the respective wall 105. The electric motors 151 are connected with the axes 153 through a drive connection 155, for example in the form of gears and a chain, and can thereby drive the wheels 154 and move the support component 3 within the elevator shaft 103.

Figure 3:
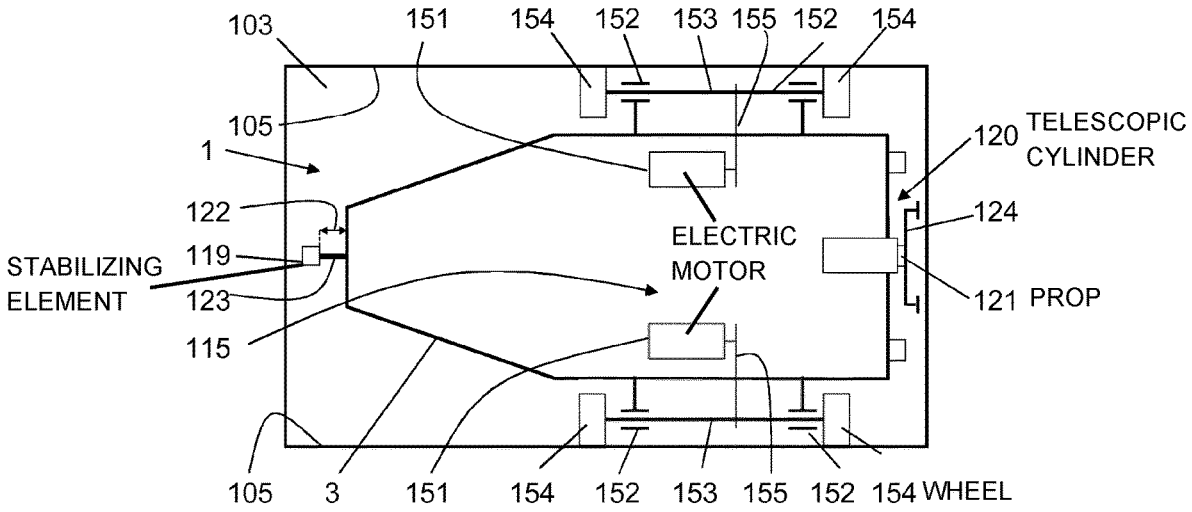
FIG. 3 illustrates a plan view of an elevator shaft of an elevator system with a mounting device according to an alternative embodiment of the present invention comprised therein.

In FIG. 3, a fixing component is also arranged on the support component 3 on the side where there is no displacement component 115. This fixing component consists of a stabilizing element 119 and a telescopic cylinder 120. The stabilizing element 119 is arranged so that it is located on a side with doorways 106 in the walls 105 of the elevator shaft 103, not shown in FIG. 3 (analogous to FIG. 1). The mounting device 1 is thus placed in the elevator shaft 103 in such a way that the stabilizing element 119 is arranged accordingly.

The elongated stabilizing element 119 has a largely cuboid or beam-shaped basic shape and is oriented in the vertical direction. Analogous to the depiction in FIGS. 1 and 2, it extends across the entire vertical extent of the support component 3 and also still protrudes across the support component in both directions. The stabilizing element 119 is connected to the support component 3 through two cylindrical connecting elements 123. The connecting elements 123 consist of two parts, which are not separately illustrated, that can be manually pushed together and pulled apart, whereby they can be fixed in several positions. Thus, a distance 122 can be adjusted between the stabilizing element 119 and the support component 3.

A telescopic cylinder 120 is arranged centrally on the side of the support component 3 that is opposite the stabilizing element 119. The telescopic cylinder 120 has an extendable prop 121 which is connected to a U-shaped extension element 124. The prop 121 can be extended so far towards the wall 105 of the elevator shaft 103 that the stabilizing element 119 and the extension element 124 rest against the walls 105 of the elevator shaft 103 and the support component 3 is thereby stabilized on the walls 105. The support component 3 is thus fixed in the vertical direction and in the horizontal direction, i.e., transversely to the vertical direction. In the illustrated example, the telescopic cylinder 120 is extended and retracted by an electric motor. Other types of drives, such as pneumatic or hydraulic drives, are conceivable as well.

The telescopic cylinder 120 shown in FIG. 3 is arranged on or in the area of a top surface of the support component 3. Similarly, the support component 3 also has a telescopic cylinder at or in the area of its underside.

It is also possible that two telescopic cylinders each, or more than two, for example three or four telescopic cylinders, are arranged at the same height. Here, the prop of the telescopic cylinder can, for example, come in contact with the wall of the elevator shaft at the interposition of an extension element.

A fixing component consisting of a stabilizing element and telescopic cylinders is also possible in combination with a mounting device, illustrated by way of a carrier means as shown in FIGS. 1 and 2, which can be moved within the elevator shaft.

Figure 4:
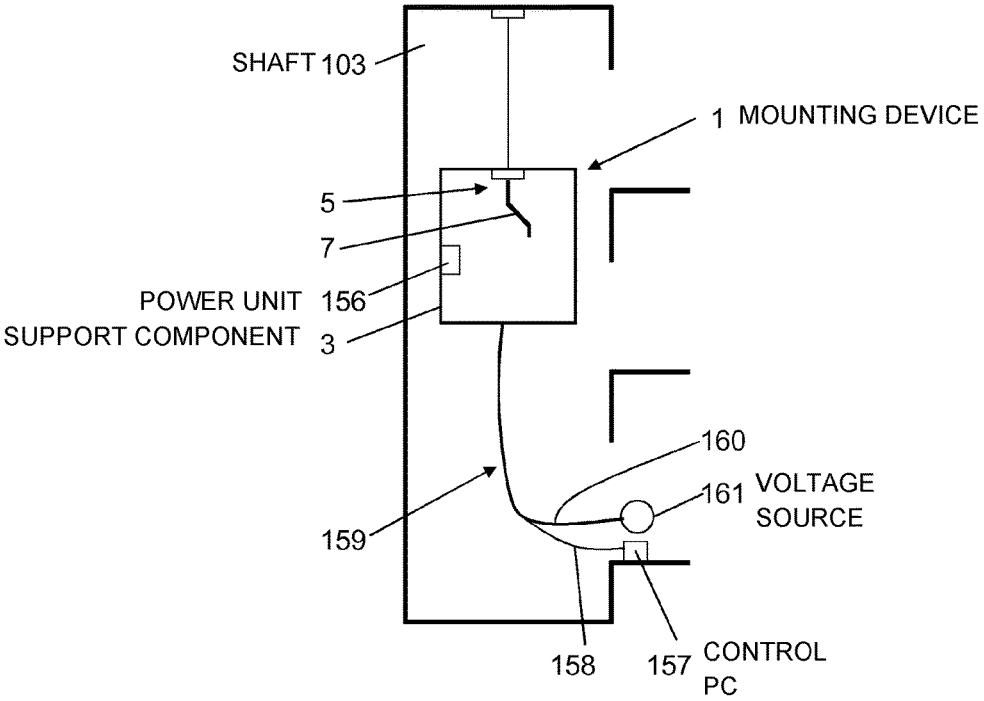
FIG. 4 illustrates a side view of an elevator shaft of an elevator system with a mounting device and its energy and communication connections comprised therein.

The mounting device must be supplied with energy in the elevator shaft, and communication with the mounting device is necessary. Such a mounting device 1 in an elevator shaft 103 is shown in FIG. 4. The mounting device 1 has a support component 3 and a mechatronic assembly component 5 in the form of an industrial robot 7. The industrial robot 7 is controlled by a controller made up of a power unit 156 arranged on the support component 3 and a control PC 157 arranged on a floor outside the elevator shaft 103. The control PC 157 and the power unit 156 are connected via a communication line 158, for example in the form of an Ethernet cable. The communication line 158 is part of a so-called traveling cable 159 which also includes power lines 160 through which the mounting device 1 is supplied with electrical energy by a voltage source 161. For reasons of clarity, the lines within the mounting device 1 are not shown.

The power section 156 of the industrial robot 7 is thus supplied with electric power via the power lines 160 and is connected to the control PC 157 via the communication line 158 in the communication link. Via the communication line 158, the control PC 157 can thus send control signals to the power section 156, which it then converts into concrete activations of the individual electric motors of the industrial robot 7, which are not shown here, and thus move the industrial robot 7 in the manner defined by the control PC 157.

Figure 5:
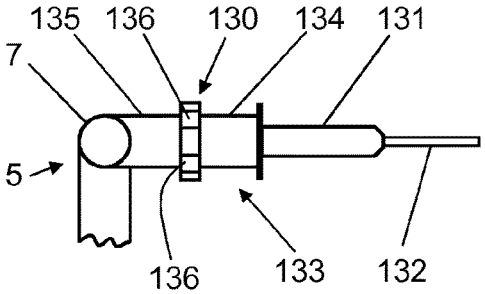
FIG. 5 illustrates a part of an assembly component configured as an industrial robot with a damping element and a mounting tool in the form of a drill coupled with it.

FIG. 5 illustrates a part of an assembly component 5 configured as an industrial robot 7 with a damping element 130 and mounting tool in the form of a drill 131 coupled with it. A drill bit 132 is inserted in the drill 131, which is driven by the drill 131. The damping element 130 consists of several rubber pads 136 arranged in a parallel manner, which can each be considered a damping element. The damping element 130 is inserted into an arm 133 of the industrial robot 7 and divides this into a first part 134 on the drill side and a second part 135. The damping element 130 connects the two parts 134, 135 of the arm 133 of the industrial robot 7 and passes shocks and vibrations triggered by the drill bit 132 to the second part 135 in a dampened manner.

Figure 6:
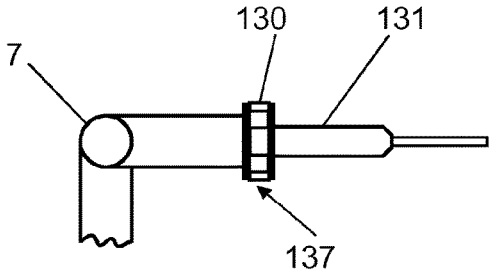
FIG. 6 illustrates a part of an assembly component configured as an industrial robot with a damping element in a connecting element of a mounting tool in the form of a drill.

According to FIG. 6, a damping element 130 may also be arranged as a mounting tool in the form of a drill 131 in a connecting element 137 of an industrial robot 7. The damping element is basically configured in the same way as the damping element 130 in FIG. 5. The connecting element 137 is fixed to the drill 131 so that the industrial robot 7 accommodates the combination of the connecting element 137 and drill 131 to drill a hole in a wall of the elevator shaft.

It is also possible that a damping element is configured as an integral part of a drill.

To monitor wear of the drill bit 132 of the drill 131, a feed is monitored during drilling and/or a period of time for creating a hole of a desired depth. When falling below a feed limit and/or when a time limit is exceeded, the drill bit used is recognized as no longer in order and generates a respective message.

Figure 7A:
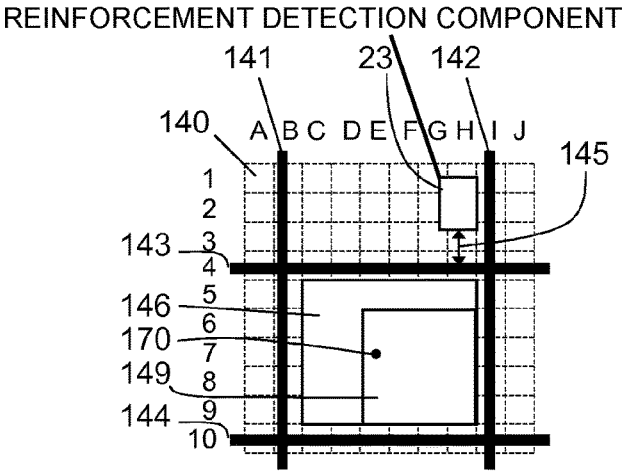
FIGS. 7*a* and 7*b* show reinforcements in a wall of an elevator shaft in two areas in which related holes are to be drilled and an illustration of a search for possible drilling sites.
Figure 7B:
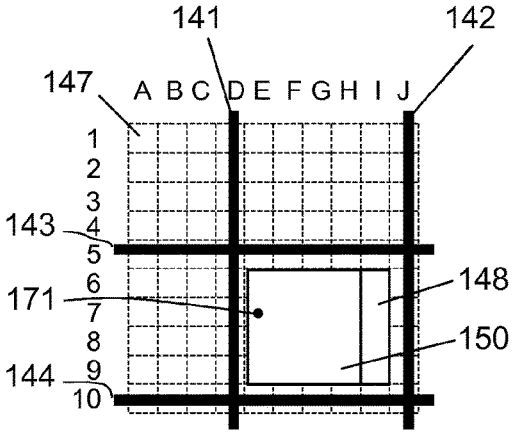

FIGS. 7*a* and 7*b* describe a method for mapping the location of reinforcements within a wall of the elevator shaft and a method for establishing a first and a corresponding second drilling position.

FIG. 7*a* illustrates an area 140 of a wall of an elevator shaft in which drilling is performed at a first drilling position. For a better description of the method, the area 140 is divided into grid squares which are marked to the right with consecutive letters A through J and down with ascending numbers 1 to 10. This allocation was carried out analogously in FIG. 7*b*.

In the area 140 shown in FIG. 7*a*, first and second reinforcements 141, 142 extend from top to bottom, whereby they run parallel to each other in a straight manner, at least in the illustrated area 140. The first reinforcement 141 runs here from B1 to B10 and the second reinforcement 142 from I1 to I10. In addition, third and fourth reinforcement 143, 144 run from left to right, whereby they run parallel to each other in a straight manner, at least in the illustrated area. The third reinforcement 143 in this case runs from A4 to J4 and the fourth reinforcement 144 from A10 to J10.

To create a map of the position of the reinforcements 141, 142, 143, 144 shown, the assembly component 5 guides the reinforcement detection component 23 several times along the wall 105 of the elevator shaft. The reinforcement detection component 23 is first moved several times from top to bottom (and vice versa) and then from left to right (and vice versa). During the movement, the reinforcement detection component 23 continuously supplies the distance 145 to the closest reinforcement 143 in the direction of the motion so that it is possible to create the shown map of the location of the reinforcements 141, 142, 143, 144 from the known position of the reinforcement detection component 23 and said distance 145.

Once the location of the reinforcements 141, 142, 143, 144 is known, a first potential area 146 can be determined for the first drilling position. In FIG. 7*a*, this first potential area 146 is a rectangle with the corners C5, H5, C9 and H9.

The area 147 of a wall of an elevator shaft shown in FIG. 7*b* is, for example, laterally offset against the area 140 in FIG. 7*a*. A second drilling is to be performed in this area 147, whereby, however, the drilling position cannot be chosen freely, but must be determined according to a predetermined manner in relation to the first drilling position in the area 140 according to FIG. 7*a*. The second drilling position corresponding to the first drilling position must, for example, be laterally offset from the first drilling position by a certain distance. In the illustrated example, the area 147 in FIG. 7*b* is laterally offset by this distance from the area 140 in FIG. 7*a*. Corresponding first and second drilling positions are arranged in corresponding grid squares in the example shown in FIGS. 7*a* and 7*b*. So, if the first hole in grid square B2 in the area 140 of FIG. 7*a* is carried out, the second hole in the area 147 of FIG. 7*b* must be carried out in the grid square B2 as well. In this way, the second drilling is correctly positioned relative to the first drilling.

As reinforcements in walls are not aligned equally over their entire length, the courses of the reinforcements 141, 142, 143, 144 in FIG. 7*b* are not the same as in FIG. 7*a*. The first reinforcement 141 in FIG. 7*b* runs from D1 to D10 and the second reinforcement 142 from J1 to J10. The third reinforcement 143 in FIG. 7*b* runs from A5 to J5 and the fourth reinforcement 144 as in FIG. 7*a* from A10 to J10.

After, as described with regard to FIG. 7*a*, a map of the position of the reinforcements 141, 142, 143, 144 has been generated for the area 147 in FIG. 7*b* as well, a second potential area 148 can be determined for the second drilling position. In FIG. 7*b*, this second potentially possible area 148 is a rectangle with the corners E6, I6, E9 and I9. The possible areas for the first and second drilling position result from the overlapping area of the first area 146 and the second area 148. From this follows for the first drilling position a rectangular area 149 and for the second drilling position a rectangular area 150, each with the corners E6, H6, E9, H9. From these areas 149, 150, a grid square can be selected for the first and second drilling position. In the example illustrated in FIGS. 7*a*, 7*b*, the first drilling position 170 in FIG. 7*a* and the second drilling position 171 in FIG. 7*b* are each specified in the grid square E7.

Figure 8A:
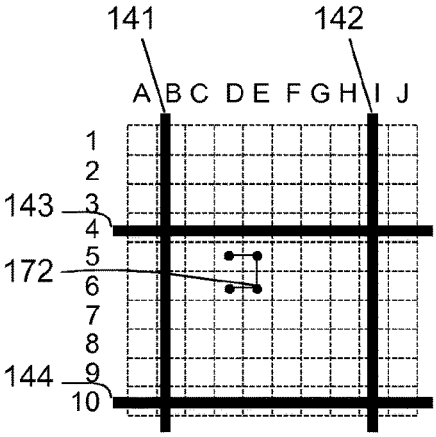
FIGS. 8*a* and 8*b* show reinforcements in a wall of an elevator shaft in two areas in which related holes are to be drilled and an illustration of an alternative search for possible drilling sites.
Figure 8B:
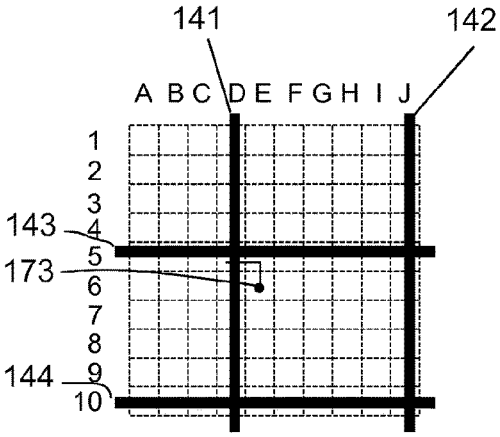

FIGS. 8*a* and 8*b* describe an alternate method to determine a first and a corresponding second drilling position. The arrangement of the reinforcements 141, 142, 143, 144 in FIG. 8*a* corresponds to the arrangement in FIG. 7*a*, and the arrangement in FIG. 8*b* corresponds to the arrangement in FIG. 7*b*. The division into grid squares is identical as well.

First, possible positions are determined for the first drilling position according to FIG. 8*a*. To this purpose, the reinforcement detection component 23 is used to determine whether it is possible to drill at a desired drilling position, here D5. This is the case here. Then other possible positions for the first drilling position are sought. To this purpose, additional grid squares are checked in a spiral and clockwise manner, starting from the desired drilling position D5, so here successively E5, E6, and D6. Once four possible positions have been found, the search for other possible positions is discontinued. If one of the positions had not been an option due to a reinforcement, the search would have continued until four possible positions were found.

Then, as shown in FIG. 8*b*, a possible second drilling position will be sought. Due to the assignment of the two drilling positions described, the second drilling position must be located in the same grid square as the first drilling position. It is checked first whether the desired drilling position, i.e., D5 in this case, is possible in the second drilling position. In the example shown, this is not possible due to a collision with the reinforcement 141, so the search continues in a spiral manner analogous to the procedure used for the first drilling position. The second possible position E5 is not possible due to a collision with the reinforcement 143. The third possible position E6 is possible, so that in the example illustrated in FIGS. 8*a* and 8*b*, the first drilling position 172 in FIG. 8*a* and the second drilling position 173 in FIG. 8*b* are both determined to be in the grid square E6.

Finally, it should be noted that terms such as "comprising" and the like do not preclude other elements or steps, and terms such as "a" or "one" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A mounting device for performing an assembly job in an elevator shaft of an elevator system, the mounting device comprising:

a support component;

a mechatronic assembly component including an industrial robot being adapted to be coupled with various mounting tools at a cantilever end of the industrial robot;

a scanning component guided by the mechatronic assembly to positions along a wall of the elevator shaft and continuously measuring a distance from the positions to the wall of the elevator shaft thereby allowing determination of angular position and a condition of the wall, including irregularities, ledges, or existing holes in the wall wherein the support component is adapted to be moved relative to the elevator shaft and to be positioned at different heights within the elevator shaft;

wherein the mechatronic assembly component is held at the support component and adapted to perform a mounting step as part of the assembly job in at least a partially automatic manner; and wherein the mounting device uses the measured distance from the scanning component to adjust a control of the mechatronic assembly component in performing the mounting step of the assembly job.

2. The mounting device according to claim 1 including a positioning component being at the support component and adapted to determine at least one of a position and an orientation of the mounting device within the elevator shaft.

3. The mounting device according to claim 1 wherein the mechatronic assembly component is adapted to carry out several different types of mounting steps in at least a partially automatic manner.

4. The mounting device according to claim 3 wherein the mechatronic assembly component is adapted to use the various mounting tools for the different types of the mounting steps.

5. The mounting device according to claim 4 wherein the mechatronic assembly component is adapted to pick up each of the various mounting tools prior to a performance of an associated one of the mounting steps.

6. The mounting device according to claim 4 including a tool magazine component at the support component adapted to store the various mounting tools and to provide the various mounting tools to the mechatronic assembly component.

7. The mounting device according to claim 1 wherein the mechatronic assembly component is adapted to perform at least one of the following mounting steps:

at least a partially automatically controlled drilling of holes in a wall of the elevator shaft;

at least a partially automated driving of screws into holes in a wall of the elevator shaft; and at least a partially automatic mounting of components on the wall of the elevator shaft.

8. The mounting device according to claim 1 including a displacement component adapted to move the support component vertically within the elevator shaft.

9. The mounting device according to claim 8 wherein the displacement component is fixed on one of the support component and a stop on top of the elevator shaft, the displacement component including a carrier means being flexible under tension, a one end of the carrier means being held at the displacement component and another end of the carrier means being fixed at the support component or the stop on top of the elevator shaft, wherein the displacement component moves the support component within the elevator shaft by moving the carrier means.

10. The mounting device according to claim 8 wherein the displacement component is attached to the support component and is adapted to exert a force on a wall of the elevator shaft to move the support component within the elevator shaft by moving the displacement component along the wall.

11. The mounting device according to claim 1 wherein the support component includes a fixing component adapted to fix at least one of the support component and the mechatronic assembly component within the elevator shaft in a direction transverse to a vertical direction of the elevator shaft.

12. The mounting device according to claim 1 including a reinforcement detection component at the support component adapted to detect a reinforcement within a wall of the elevator shaft.

13. A method for performing an assembly job in an elevator shaft of an elevator system comprising the steps of:

introducing a mounting device in the elevator shaft, the mounting device including a support component and a mechatronic assembly component, the support component being adapted to be moved relative to the elevator shaft and to be positioned at different heights within the elevator shaft, where the mechatronic assembly component is held at the support component and includes an industrial robot adapted to be coupled with various mounting tools at a cantilever end of the industrial robot;

guiding a scanning component to positions along a wall of the elevator shaft by the mechatronic assembly component and continuously measuring a distance from the positions to the wall of the elevator shaft thereby allowing determination of angular position and a condition of the wall, including irregularities, ledges, or existing holes in the wall;

controlling displacement of the mounting device within the elevator shaft; and performing at least partially automatically a mounting step of the assembly job with the mechatronic assembly component of the mounting device, wherein the mounting device uses the measured distance from the scanning component to adjust a control of the mechatronic assembly component in performing the mounting step of the assembly job.

* * * * *